United States Patent [19]

Farrell

[11] Patent Number: 4,606,963

[45] Date of Patent: Aug. 19, 1986

[54] SYNTHETIC CLAY TENNIS COURT AND METHOD OF MAKING THE SAME

[76] Inventor: Dominic L. Farrell, 297 Senneville, Senneville, Quebec J0P 1H0, Canada

[21] Appl. No.: 705,860

[22] Filed: Feb. 27, 1985

Related U.S. Application Data

[63] Continuation of Ser. No. 288,967, Jul. 31, 1981, abandoned, which is a continuation of Ser. No. 34,592, Apr. 30, 1979, abandoned.

[51] Int. Cl.[4] ..... B32B 5/16; B32B 5/22

[52] U.S. Cl. ..... 428/150; 428/143; 428/149; 428/220; 428/489; 404/17; 404/27

[58] Field of Search ..... 428/317.9, 150, 331, 428/489, 308, 218, 149, 143, 220, 213; 272/3; 273/29 R, 31; 404/28, 30, 27, 52, 44, 17, 71; 156/71; 427/136

[56] References Cited

U.S. PATENT DOCUMENTS

| | | | |
|---|---|---|---|
| 1,628,679 | 5/1927 | Neath | 404/17 |
| 1,970,639 | 8/1934 | Winkleman | 404/17 |
| 2,042,377 | 5/1936 | Bamber | 428/489 |
| 2,067,356 | 1/1937 | Swinhoe | 404/71 |
| 2,408,251 | 9/1946 | Dantz | 428/418 |
| 3,012,485 | 12/1961 | Bradley | 428/418 |
| 4,136,215 | 1/1979 | den Offer | 428/308 |

FOREIGN PATENT DOCUMENTS

| | | | |
|---|---|---|---|
| 496807 | 12/1938 | United Kingdom | 273/29 R |

*Primary Examiner*—Alexander S. Thomas

*Attorney, Agent, or Firm*—Thompson, Birch, Gauthier, Samuels, Stevens & Kehoe

[57] ABSTRACT

A synthetic clay court composition is provided having a first aggregate-containing elastomeric lamina applied to a substrate. Prior to the elastomer curing aggregate is broadcast over the elastomer in an amount sufficient to form a second free-flowing lamina.

8 Claims, 1 Drawing Figure

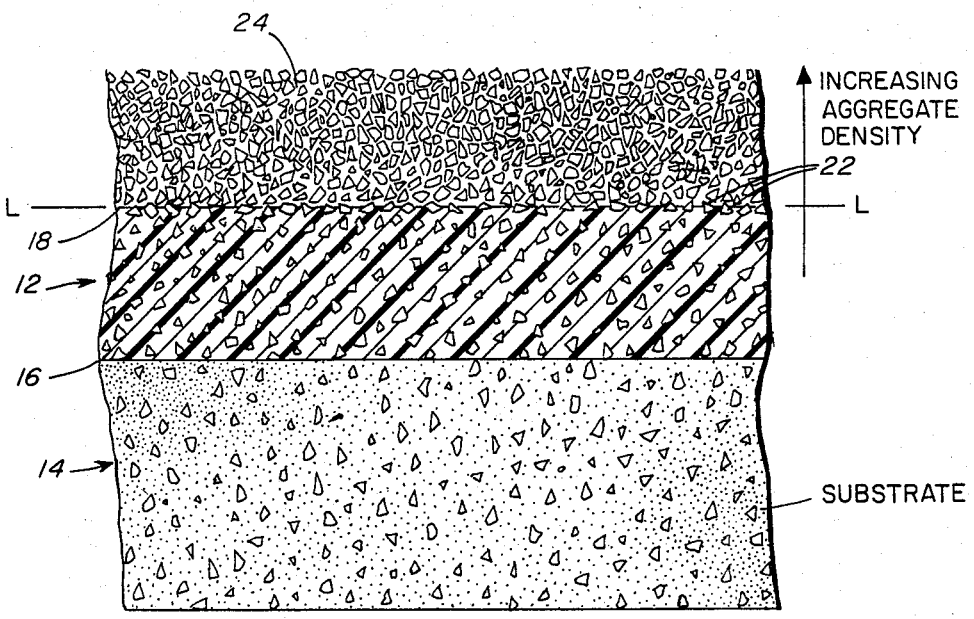
24
INCREASING
AGGREGATE
DENSITY
22
L
L
18
12
16
14
SUBSTRATE

SYNTHETIC CLAY TENNIS COURT AND METHOD OF MAKING THE SAME

This is a continuation of co-pending application Ser. No. 288,967 filed on July 31, 1981, abandoned, which is a continuation of application Ser. No. 34,592, filed Apr. 30, 1979, abandoned.

BACKGROUND OF THE INVENTION

With the expansion of tennis as a participant sport, the construction of tennis courts has multiplied. Tennis courts have been constructed of many types of surfaces including grass, clay, dirt, asphalt or macadam, concrete, wood, linoleum, brick and synthetic turf. Wood and linoleum are used primarily for indoor courts. Outdoor courts are generally surfaced with concrete, asphalt or a synthetic surface.

Concrete and asphalt require very little maintenance but their initial construction costs are high. Also, the hard unyielding surfaces of the concrete and asphalt cause excessive strain on the legs and feet of players.

Clay courts are less expensive to construct than concrete or asphalt, but a clay court requires a great deal of maintenance. Clay courts are generally referred to as providing "true bounce" and also have been recognized as being the most comfortable with regard to strain on the legs and feet.

Elastomeric compositions which are applied over a concrete or asphalt surface are commonly used in the new construction of tennis courts. Also, synthetic turf tennis courts have been provided. See, for example, U.S. Pat. No. 4,044,179 wherein a construction is disclosed which apparently duplicates that of a grass court. Basically, in this reference, a pile fabric is disposed on a relatively flexible sub-surface. A compacted layer of granular material is disposed among the pile of the fabric.

U.S. Pat. No. 3,438,312 discloses an aperatured synthetic tennis court surface.

It has been recognized that aggregate, mixed either alone or with a bituminous material and/or a polymeric material, is suitable for tennis courts, see U.S. Pat. No. 3,012,485. It is known when some road surfaces are laid that aggregate is subsequently added to create a non-skid surface, see U.S. Pat. Nos. 2,925,831 and 3,901,615.

In spite of all these various constructions of surfaces, a tennis court surface has not yet been developed which will be both maintenance-free and duplicate the properties of a conventional clay court. That is, a court which will provide a sliding granular surface of the proper resiliency.

The present invention relates to a tennis court composition and a method of constructing the same. The composition is applied to a substrate which substrate does not form a part of the invention. The composition comprises at least two laminae, a first adhesive lamina contacting the substrate and a second lamina of free-flowing aggregate coextensive with the surface of the first lamina and of a defined thickness.

The first lamina is a bonding adhesive composition, such as a resinous film-forming vehicle capable of ambient temperature hardening, preferably an elastomeric polymer. Further either alone or in combination therewith, a hydrocarbonaceous binder may be used. Such a binder may employ a bituminous material such as a bituminous liquid composed of a mixture of hydrogen, carbon and oxygen conforming to the specifications defined by the American Association of the State Highway and Transportation Officials. The bituminous liquid includes asphalt emulsions at an application temperature of between 50° F. to 150° F., or a combination of mineral oils and cut-back asphalts at application temperatures of between 100° F. to 200° F. Also, a paving grade asphalt may be used which would include substances containing bitumens or pyrobitumens, pyrogeneous distillates and tar, pyrogeneous waxes and pyrogeneous residues (pitches and asphalts).

The film-forming vehicle may be any elastomeric polymer. Elastomeric is defined as having the ability of a polymer strip to return to its approximate initial length after elongation to below its breaking or fracture point.

Within the scope of the invention, solvent systems may be used containing either moisture or catalyst-cured urethanes; polyesters which are esters of saturated alcohols and unsaturated acids; polyamide resins such as the VERSAMIDS and vegetable oil modified polyamids as well as epoxy resins. Aqueous emulsion vehicles are preferably employed, for example, vinyl-resin, polyvinyl acetate, acrylics and acrylic ester copolymer emulsions, synthetic and natural latex and the like. Some resins such as the polyesters, the acrylates, methacrylates, and particularly acrylate-acid polymers and copolymers can be used in either solvent or emulsion systems.

The particles of aggregate admixed with the first lamina are of a particle size and amount such that when the first lamina is spread to its final thickness, between 30 to 70%, preferably 50% of the upper surface of the composition will be coated aggregate extending beyond the upper level of the applied film-forming vehicle. This irregular non-uniform upper surface structurally forms a dimensionally stable non-bonding upper adhesive surface.

The second lamina is a free-flowing aggregate of defined thickness and particle size. The second lamina is relatively held in place by the adhesive upper surface of the first lamina and this results in a sliding friction between the first and second laminae. The thickness of the second lamina is such that in combination with the first lamina, the "true bounce" of a tennis ball is achieved.

My invention in a preferred embodiment is a tennis court composition which comprises a first lamina of an elastomeric film-forming vehicle having admixed therewith particles of aggregate comprising 25 to 75% of the total lamina by volume. The composition is applied to a substrate the lower surface adhering to the substrate, the upper surface characterized by a roughened non-uniform gravel-like surface. A second lamina of free-flowing aggregate contacts the upper surface of the first lamina, the second lamina forming with the first lamina a resilient composition, the second lamina engaged to the first by the gravel-like surface in a sliding friction relationship. The thickness of the second lamina is one to three times the total thickness of the first lamina.

BRIEF DESCRIPTION OF THE DRAWINGS

The drawing is a sectional view of a tennis court composition embodying my invention.

DESCRIPTION OF THE PREFERRED EMBODIMENT

In the invention an air-drying film-forming elastomeric vehicle is used. The vehicle may be either a solvent system or an aqueous system. Because the composition is applied to various substrates, such as an asphalt surface or a concrete surface, the aqueous emulsion systems are preferred in that solvent systems would solvate the asphalt on which they are placed. However, an additional step to seal or protect an asphalt surface from the solvent system could be employed. Further, the vehicle is such that in addition to air-drying or curing, it will cure at ambient temperatures between 40° to 100° F.

For solvent systems any of the binders described in U.S. Pat. No. 3,527,146, Columns 2 and 3 which are hereby incorporated in this application in their entirety may be used. Preferably aqueous emulsion vehicles are employed, for example, vinyl resins emulsions, polyvinyl acetate, acrylic ester copolymer emulsions, synthetic and natural latex, and the like. Examples are vinyl plastics such as polyvinyl chloride, polyvinyl acrylate, vinyl chloride, polyvinyl acetals, vinyl chloride, polyvinyl acetals, vinyl acetate copolymers, monovinyl acetylene polymers such as the neoprenes, particularly neoprene AC and neoprene AD, styrene-butadiene and similar copolymers, chlorinated rubber, and butyl rubber.

The invention will be described in conjunction with a typical formulation which will further exemplify the invention. The example is for purpose of illustration only since, obviously, various other additives normally incorporated in such elastomeric vehicles can be included in the formulations.

EXAMPLE

| Percent by Weight | Material |
|---|---|
| 50.8% | acrylic aqueous emulsion (Rohm & Haas AC 235 80% —LC 45 20%) (48.8% non volatile) |
| 0.3% | anti-foam (blend of organic and silica derivative) |
| 1.0% | dispersent (sodium salt of polymeric carboxylic acid) |
| 0.3% | surfactant (alkylaryl polyether) |
| 3.6% | ethylene glycol |
| 1.0% | coalescing agent (Texanol)2,2,4-trimethyl-1,3-pentanediol monoisobutyrate |
| 1.0% | aluminium silicate |
| 2.4% | magnesium silicate (Talc) |
| 19.1% | silica #1160 Illinois Minerals Co. Cario, Illinois |
| 2.5% | chromium oxide |
| 4.8% | ground rubber (passing 30 retained on 40 U.S. mesh from used automobile tires) |
| 0.3% | hydroxyethyl cellulose |
| 11.2% | water |
| 1.6% | ammonium polyacrylate solution |
| 0.1% | phenol mercuric acetate |

To three parts of this formulation is added two parts of aggregate and one part of water, all on a per volume basis. The final vehicle is such that the particles of aggregate when admixed will not precipitate out of the composition. The aggregate has a particle size lying in the range between 10 to 35 Tyler series (passing 10 retained on 35). The ratios broadly are 2:4 and 1:2 and 0.5:1.5, respectively.

This material is spread such as by squeegee or roller onto a prepared sub-surface, such as an existing asphalt or concrete tennis court surface. Alternatively, a sub-surface could be constructed which would be the equivalent of a standard concrete or asphalt surface. By prepared is simply meant that the surface is cleaned, such as with a detergent, rinsed and smoothed (patched) prior to the application of the vehicle. The vehicle is applied until the upper surface of the substrate is completely covered. Typically, for the average tennis court, 7200 square feet, this will require approximately 150 gallons of vehicle resulting in an average thickness of from ⅛ to ½ of an inch preferably, ⅜ of an inch thick.

Referring to the drawing, this vehicle as a first lamina 12 is applied to a substrate 14. The first lamina comprises a lower surface 16 which adhesively bonds to the substrate 12. It further comprises an upper surface 18 wherein a gravel-like texture is presented. As seen from the drawing, the aggregate is contained completely within and extends or projects out of the upper vehicle surface defined by the dotted line L—L. This extending aggregate is identified as 22. It can be seen that the upper surface, wherein the aggregate 22 projects above the vehicle surface, forms a second adhesive surface.

Prior to the first lamina curing, a free-flowing aggregate is broadcast thereon. The aggregate or granular material used has a particle size lying in the range of from 4 Tyler mesh (4 U.S.) to 35 Tyler mesh (40 U.S.), preferably in the range of from 14 to 28 Tyler. In the example #11 grade roofing granule (3M Company) was used having the following characteristics:

| Tyler screens - Retained on | |
|---|---|
| 10 | 0–8% |
| 14 | 25–45% |
| 20 | 25–40% |
| 28 | 15–25% |
| 35 | 3–9% |
| 35 | 0–3% |

The result is the formation of a second lamina 24 bound to the first lamina in a sliding friction relationship. The second lamina 24 is of about the same thickness of the first lamina. In practice the second lamina is simply rolled on. For an average tennis court surface of 7200 square feet, approximately five (5) tons of such aggregate is used. It will be noted from the drawing that there is an increasing density of aggregate from a lower density in the first lamina through an intermediate density where the adhesive upper surface is formed to a maximum density of the second lamina which comprises the free-flowing aggregate.

The aggregate used in both laminae is volcanic rock of the above described particle size. Other mineral or polymeric granular material may be used within the particle size range described above and having a hardness plus or minus 20% of that commonly found with the volcanic rock. Mineral material such as crushed stone, slag, gravel, sand, volcanic aggregate (U.S. Pat. No. 2,925,831), crushed shells, quartz, finely divided aluminum oxide are suitable.

Similarly, other film-forming vehicles such as described may be used, which are the equivalent of the specific example. One skilled in the art would be able to formulate such a vehicle whether solvent or water based.

Having described my invention what I now claim is:

1. A tennis court surface laminae which consists essentially of:

(a) a first lamina having an upper surface and a lower surface, the lower surface adhesively engaging a sub-surface, the lamina comprising:

a film forming vehicle selected from the group consisting of elastomers and bituminous materials and adapted for ambient temperature curing:

aggregate disposed in the vehicle, at least a portion of the aggregate extending beyond the upper surface to provide a roughened non-uniform gravel-like texture between 30 to 70% of the upper surface of the composition comprising coated aggregate extending beyond the upper level of the vehicle;

(b) a second lamina of free-flowing particles of aggregate having an upper and a lower surface the second lamina having a thickness of one to three times the thickness of the first lamina, the lower surface contacting the upper surface of the first lamina and the aggregate extending from the upper surface of the first lamina in sliding frictional engagement and the particle size of the aggregate used in both the first and second laminae being between 4 Tyler and to 35 Tyler mesh.

2. The composition of claim 1 wherein the film-forming vehicle is a bituminous material and has an application temperature of between 50°-200° F.

3. The composition of claim 2 wherein the film-forming vehicle is an elastomer selected from the group consisting of urethanes, polyamides, polyesters, acrylics, acrylates, methacrylates and combinations thereof.

4. The composition of claim 1 wherein the film-forming vehicle is an aqueous acrylic resin emulsion.

5. The composition of claim 1 wherein the thickness of the first lamina is from $\frac{1}{8}$ to $\frac{5}{8}$ inches thick and the second lamina is at least equal in thickness to the first lamina.

6. The composition of claim 1 wherein the aggregate is a mineral aggregate.

7. The composition of claims 4, 5 or 6 wherein the aggregate is selected from the group consisting of stone, slag, gravel, sand, volcanic rock, cracked shells, quartz or finely divided aluminum oxide.

8. The composition of claim 7 wherein the aggregate is the first lamina comprising between 25-75% of the total volume of the first lamina.

* * * * *